United States Patent [19]

Riekels

[11] 4,255,188

[45] Mar. 10, 1981

[54] FREE MACHINING STEEL WITH BISMUTH AND MANGANESE SULFIDE

[75] Inventor: Lynda M. Riekels, Munster, Ind.

[73] Assignee: Inland Steel Company, Chicago, Ill.

[21] Appl. No.: 70,830

[22] Filed: Aug. 29, 1979

[51] Int. Cl.[3] ..... C22C 38/60

[52] U.S. Cl. ..... 75/123 AA; 75/123 R; 75/123 A; 75/123 F; 75/123 G; 75/123 N; 75/129; 148/2; 148/12 R

[58] Field of Search ..... 75/123 R, 123 A, 123 AA, 75/123 F, 123 G, 123 N, 129; 148/2, 12 R

[56] References Cited

U.S. PATENT DOCUMENTS

| | | | |
|---|---|---|---|
| 2,378,548 | 6/1945 | Gregg et al. | 75/123 A |
| 2,978,320 | 4/1961 | Larson et al. | 75/123 AA |
| 3,152,889 | 10/1964 | Holowaty | 75/123 AA |
| 3,152,890 | 10/1964 | Holowaty | 75/123 AA |
| 3,634,074 | 1/1972 | Ito et al. | 75/123 AA X |
| 3,679,400 | 7/1972 | Nachtman | 75/123 AA |
| 3,705,020 | 12/1972 | Nachtman | 75/123 R |
| 3,723,103 | 3/1973 | Kato et al. | 75/123 AA X |
| 3,973,950 | 8/1976 | Itoh et al. | 75/123 A X |
| 4,004,922 | 1/1977 | Thivellier et al. | 75/123 AA |

FOREIGN PATENT DOCUMENTS

| | | | |
|---|---|---|---|
| 47-206 | 11/1972 | Japan | 75/123 AA |
| 1020535 | 2/1966 | United Kingdom | 75/123 AA |

OTHER PUBLICATIONS

Watson et al., "Metallurgy of Free Machining Steels," BHP Tech. Bull., 21(1), May 1977, pp. 22–32.

*Primary Examiner*—L. Dewayne Rutledge
*Assistant Examiner*—W. G. Saba
*Attorney, Agent, or Firm*—Merriam, Marshall & Bicknell

[57] ABSTRACT

A free machining cast steel shape has in its microstructure, both bismuth-containing inclusions and manganese sulfide inclusions. The manganese sulfide inclusions act as microcrack initiators, and the bismuth-containing inclusions act as liquid metal embrittlers, propagating the microcracks. The mean size and spacing of the manganese-sulfide inclusions are controlled.

8 Claims, No Drawings

FREE MACHINING STEEL WITH BISMUTH AND MANGANESE SULFIDE

BACKGROUND OF THE INVENTION

The present invention relates generally to free machining cast steel shapes containing bismuth and more particularly to a bismuth-containing cast steel shape in which the frequency with which the bismuth may function as a liquid metal embrittler is increased.

In the machining of steel, a cutting tool is applied to the surface of the steel, and either the steel or the tool is moved relative to the other to effect a cutting of the steel by the tool. This forms chips of steel which are removed from the steel during the machining operation. Chip formation is related to the formation and propagation of microcracks in the steel.

More specifically, during machining, a force is applied to the steel at the location where the cutting edge of the tool contacts the steel and this force causes microcracks to form in the steel. These microcracks may originate at inclusions in the steel, or these microcracks may extend into the steel from the location where the steel is contacted by the cutting edge of the tool to an innermost tip of the microcrack. These microcracks generally proceed along grain boundaries or inter-phase boundaries in the steel. To propagate these microcracks requires the expenditure of energy during the machining operation. The smaller the expenditure of energy required to propagate the microcrack, the easier it is to machine the steel and, therefore, the better the machinability of the steel.

During machining, the temperature of the steel in the vicinity of a microcrack is raised by the heat generated in the machining operation. The temperature increase of the steel, due to the machining operation, is highest at the cutting edge of the machining tool and decreases as the distance from the cutting edge increases.

If a liquid metal embrittler is present at or in the vicinity of the innermost tip of a microcrack, the energy required to propagate the microcrack is lowered. A liquid metal embrittler is a metal or alloy which has a relatively low melting point, so that it is liquid at the temperature prevailing at the tip of the microcrack during machining, and which also has a relatively low surface free energy value near its melting point so as to impart to the liquid metal embrittler the ability to wet a relatively large surface area along grain boundaries or inter-phase boundaries. The lower the surface-free energy value (or surface tension), the greater the surface area coverage of the liquid metal embrittler. Normally, the surface free energy value of a liquid metal embrittler rapidly decreases (and thus its wetting ability rapidly increases) at the melting point of the liquid metal embrittler.

When a microcrack is initially propagated in the vicinity of an inclusion containing a liquid metal embrittler, and the temperature at the location of that inclusion has been raised sufficiently to liquify the liquid metal embrittler, there is an almost immediate transport of liquid metal embrittler to the tip of the microcrack. This transport proceeds along grain boundaries, phase boundaries or the like. The liquid metal embrittler thus transported may be a layer only a few atoms thick, but that is enough to perform its intended function as a liquid metal embrittler at the microcrack.

The lower the melting point of the liquid metal embrittler and the stronger its tendency to wet the steel grain boundaries or inter-phase boundaries, the farther away from the tool cutting edge are regions of the steel embrittled for easier fracture.

The extent to which a liquid metal embrittler functions as such is directly related to the frequency of opportunity for the liquid metal embrittler to undergo immediate transport to the tip of a microcrack. Accordingly, anything which increases the frequency of opportunity for the liquid metal embrittler to undergo immediate transport to the tip of a microcrack is desirable.

Elements which have been added to steel to increase its machinability include lead, tellurium, bismuth and sulfur, all of which are present as inclusions in the microstructure of the steel. Heretofore it has been considered undesirable for the microstructure to contain fine-sized inclusions of machinability increasing elements. For example, with respect to manganese sulfide inclusions, 15 microns is considered an optimum mean size, with inclusion sizes being generally in the range 10–30 microns, and 5 microns is considered bad.

SUMMARY OF THE INVENTION

A free machining cast steel shape in accordance with the present invention comprises features which enhance the opportunity for bismuth-containing inclusions to act as liquid metal embrittlers. More specifically, when a steel includes, in its microstructure, both manganese sulfide inclusions and bismuth-containing inclusions, these two types of inclusions cooperate to enhance the machinability of the steel. The manganese sulfide inclusions act as microcrack initiators, and the bismuth-containing inclusions act as liquid metal embrittlers, propagating the microcracks.

When the manganese sulfide inclusions have a mean size greater than two microns and less than ten microns, this increases the number of manganese sulfide inclusions which act as microcrack initiators, compared to a steel having the same amount of manganese sulfide in inclusions of larger size, and this in turn enhances the opportunity for the bismuth-containing inclusions to act as liquid metal embrittlers.

In a preferred embodiment of the invention, the manganese sulfide inclusions not only have a mean size greater than two and less than ten microns but, also, the manganese sulfide inclusions are spaced apart less than 100 microns.

The steel may be cast into an ingot shape or into a billet shape (e.g., by continuous casting). When cast into an ingot, the steel shape may be hot rolled into a billet. The billets may be further reduced by hot rolling, and the resulting hot rolled product may be cold drawn into bars. The properties imparted to the cast steel shape by the present invention will be carried forward to subsequent stages of reduction. Accordingly, as used herein the term "cast steel shape" includes both the original shape, before reduction, and the reduced shape.

Other features and advantages are inherent in the cast steel shape claimed or disclosed or will become apparent to those skilled in the art from the following detailed description.

DETAILED DESCRIPTION

A free machining cast steel shape in accordance with the present invention has a steel composition within the following range, in weight percent:

Carbon—0.06–1.0

Manganese—0.3–1.6

Silicon—0.30 max.
Sulfur—0.03–0.50
Phosphorous—0.12 max.
Bismuth—0.05–0.40
Iron—Essentially the balance The phrase "essentially the balance," as applied to iron, allows for the inclusion of those impurities usually found in steel, except for those ingredients which lower the wetting ability of bismuth, this exception being in the preferred embodiments of the present invention. With respect to such ingredients, the total amount thereof should be less than the bismuth content of the steel. The ingredients which lower the wetting ability of bismuth are copper, tin, zinc and nickel. Preferably, the total amount of these ingredients should be less than 60% of the bismuth content of the steel.

Tellurium enhances the wetting ability of bismuth, and, in one embodiment, tellurium may be included in the steel in an amount up to 0.06 weight percent, there being preferably at least 0.015 weight percent tellurium in the steel. Lead may also be added to the steel, to improve the machinability of the steel, in an amount up to 0.3 weight percent.

A free machining cast steel shape in accordance with the present invention includes, in its microstructure, manganese sulfide inclusions which act as microcrack initiators and bismuth-containing inclusions which act as liquid metal embrittlers during a machining operation. The manganese sulfide inclusions have a mean size greater than two microns and less than ten microns, to increase the number of manganese sulfide inclusions which act as microcrack initiators, compared to a steel having the same amount of manganese sulfide in inclusions of larger size, thereby enhancing the opportunity for the bismuth-containing inclusions to act as liquid metal embrittlers. Preferably, the mean inter-particle spacing of the manganese sulfide inclusions is less than 100 microns. In a free machining cast steel shape having the characteristics described in the preceding two sentences, the steel would contain at least 0.37 wt.% sulfur and more than 0.63 wt.% manganese.

Preferably, the manganese sulfide inclusions have a mean size no greater than eight microns. Manganese sulfide inclusions having a mean size below two microns would not be effective as microcrack initiators.

The bismuth-containing inclusions in the steel may comprise elemental bismuth or bismuth associated in intermetallic compounds with tellurium or lead or both, in steels wherein tellurium or lead or both are also included in the composition. To a large extent, the bismuth-containing inclusions are closely associated with manganese sulfide inclusions, e.g., as tails on the manganese sulfide inclusions in steel shapes which have undergone reduction.

Manganese and sulfur may be added to the molten steel in the ladle from which the steel is poured into the casting mold. Bismuth may be added to the molten steel as the latter is being introduced into a casting mold, either a continuous casting mold or an ingot mold.

A free machining cast steel shape having manganese sulfide inclusions with a mean size greater than two microns but less than ten microns may be obtained by solidifying the molten steel, during casting, at a relatively rapid solidification rate (about 20° C. or 36° F. per minute) or by lowering the temperature at which the molten steel is introduced into a casting mold from a conventional casting temperature of about 2833° F. (1556° C.) to about 2810° F. (1543° C.). However, care should be taken to avoid lowering the temperature too much or the molten steel may freeze within the ladle, from which the steel is introduced into the casting mold, near the end of the casting operation. This would be particularly so when the steel is cast into ingot molds.

The steel may be cast into individual ingots or it may be continuously cast. If the solidification rate is too slow to produce manganese sulfide inclusions of the desired size, there are a number of procedures which can be used to increase the solidification rate. For example, in the casting of ingots, the ingot molds may be chilled. In continuous casting the cooling of the casting molds may be increased by decreasing the temperature of the cooling fluid circulated through the molds or increasing its circulation rate. In addition, the rate at which the continuously cast steel is moved through the cooling zone may be increased, the temperature of the cooling sprays in the cooling zone may be decreased or the spray rate increased, or a plurality of these procedures may be used.

For a continuously cast billet having a cross-section of about 7 inches by 7 inches (17.5 cm by 17.5 cm), if the billet is fully solidified in about 9 to 11 minutes, the desired size of manganese sulfide inclusions should be obtained.

Examples of compositions which may be used in free machining cast steel shapes in accordance with the present invention are set forth below in Tables I and II. The steels set forth in Table II contain tellurium or lead or both while the steels set forth in Table I do not.

TABLE I

| | WT. % | | | |
|---|---|---|---|---|
| Ingredients | A | B | C | D |
| Carbon | 0.06–0.08 | 0.45–0.47 | 0.41–0.43 | 0.06–0.09 |
| Manganese | 0.60–0.80 | 1.52–1.60 | 1.45–1.55 | 1.05–1.10 |
| Silicon | 0.01–0.02 | 0.20–0.25 | 0.15–0.30 | 0.02 |
| Sulfur | 0.12–0.15 | 0.29–0.33 | 0.35 | 0.26–0.33 |
| Phosphorous | 0.06–0.07 | 0.03 | 0.03 | 0.06–0.09 |
| Bismuth | 0.3–0.4 | 0.27–0.33 | 0.2–0.3 | 0.1–0.2 |
| Copper | 0.05 | 0.08 | 0.08 | 0.01 |
| Tin | 0.02 | 0.04 | 0.01 | 0.008 |
| Nickel | 0.05 | 0.08 | 0.01 | 0.01 |
| Total Cu, Sn, Ni | 0.12 | 0.20 | 0.10 | 0.028 |

TABLE II

| | WT. % | | | |
|---|---|---|---|---|
| Ingredients | E | F | G | H |
| Carbon | 0.07 | 0.46 | 0.42 | 0.08 |
| Manganese | 0.95 | 1.55 | 1.50 | 0.90 |
| Silicon | 0.01 | 0.22 | 0.18 | 0.02 |
| Sulfur | 0.14 | 0.30 | 0.35 | 0.27 |
| Phosphorous | 0.06 | 0.02 | 0.02 | 0.08 |
| Bismuth | 0.38 | 0.28 | 0.22 | 0.12 |
| Tellurium | 0.04 | 0.05 | 0.05 | 0.02 |
| Lead | — | — | 0.15 | 0.12 |
| Copper | 0.1 | 0.08 | 0.02 | 0.01 |
| Tin | 0.05 | .04 | 0.01 | 0.01 |
| Nickel | 0.1 | 0.08 | 0.02 | 0.005 |
| Total Cu, Sn, Ni | 0.25 | 0.20 | 0.05 | 0.025 |

In all of the steels in Tables I and II, the balance of the composition consists essentially of iron (plus the usual impurities unless otherwise indicated).

Both Tables I and II contain examples of those embodiments of the present invention wherein certain ingredients in steel have been adjusted to enhance the ability of bismuth to function as a liquid metal embrittler. Thus, the total amount of ingredients which lower the wetting ability of bismuth (i.e., copper, tin, nickel) is less than the bismuth content of the steel. Moreover, because a liquid metal embrittler is more effective as such in a strong steel, the carbon content is at least 0.06 wt.%, to provide strength to the steel. In addition, the manganese content is greater than three times the sulfur content (as well as greater than 0.30 wt.%), thus contributing to the strength of the steel by solid solution strengthening.

The bismuth-containing inclusions have a mean size preferably less than five microns, and this size of bismuth inclusion may be obtained by the same procedures described above in connection with providing a manganese sulfide inclusion having a mean size greater than two microns and less than ten microns.

The foregoing detailed description has been given for clearness of understanding only, and no unnecessary limitations should be understood therefrom, as modifications will be obvious to those skilled in the art.

I claim:

1. In a free machining cast steel shape consisting essentially of, in wt.%, carbon—0.06–1.0
manganese—0.3–1.6
silicon—0.30 max.
sulfur—0.03–0.50
phosphorous—0.12 max.
bismuth—0.05–0.40
iron—essentially the balance said steel having, in its microstructure, manganese sulfide inclusions which act as microcrack initiators and bismuth-containing inclusions which act as liquid metal embrittlers, during a machining operation, the improvement wherein: said manganese sulfide inclusions have a mean size greater than 2 microns and less than 10 microns, to increase the number of manganese sulfide inclusions which act as microcrack initiators, compared to a steel having the same amount of manganese sulfide in inclusions of larger size, thereby enhancing the opportunity for said bismuth-containing inclusions to act as liquid metal embrittlers.

2. In a free machining cast steel shape as recited in claim 1 wherein the mean inter-particle spacing of said manganese sulfide inclusions is less than 100 microns.

3. In a free machining cast steel shape as recited in claim 2 wherein said steel contains at least 0.37 wt.% sulfur and more than 0.63 wt.% manganese.

4. In a free machining cast steel shape as recited in claim 1 wherein:

said manganese sulfide inclusions have a mean size no greater than eight microns.

5. In a free machining steel as recited in claim 1 wherein said steel further comprises up to 0.30 wt.% lead and up to 0.6 wt.% tellurium.

6. In a free machining cast steel shape as recited in claim 1 wherein said shape is an ingot.

7. In a free machining steel as recited in claim 1 wherein the total amount of ingredients which lower the wetting ability of bismuth, (copper, nickel, tin) is less than the bismuth content of said steel.

8. In a free machining steel as recited in claim 7 wherein said steel further comprises 0.015–0.06 wt.% tellurium.

* * * * *